US007054459B2

(12) United States Patent
Kuze et al.

(10) Patent No.: US 7,054,459 B2
(45) Date of Patent: May 30, 2006

(54) SURROUNDING STRUCTURE OF A LOUDSPEAKER

(75) Inventors: Mitsukazu Kuze, Osaka (JP); Hiroyuki Takewa, Kaizuka (JP); Mikio Iwasa, Katano (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 271 days.

(21) Appl. No.: 10/408,676

(22) Filed: Apr. 8, 2003

(65) Prior Publication Data

US 2003/0231784 A1 Dec. 18, 2003

(30) Foreign Application Priority Data

May 17, 2002 (JP) ..... 2002-142641

(51) Int. Cl.
*H04R 25/00* (2006.01)

(52) U.S. Cl. ..... 381/398; 381/386; 181/172

(58) Field of Classification Search ..... 381/398, 381/396, 386; 181/171, 172, 173
See application file for complete search history.

(56) References Cited

U.S. PATENT DOCUMENTS 3,997,023 A * 12/1976 White ..... 181/171
6,889,796 B1 * 5/2005 Pocock et al. ..... 181/172

FOREIGN PATENT DOCUMENTS

JP 61-276499 A 12/1986
JP 3127669 B 11/2000

* cited by examiner

*Primary Examiner*—Suhan Ni
*Assistant Examiner*—Tuan D. Nguyen
(74) *Attorney, Agent, or Firm*—Smith Patent Office

(57) ABSTRACT

The surrounding structure of the loudspeaker forms an annular structure, including attaching parts and curved part. The cross section of the curved part is in a hollow and approximately elliptical form. The height along the major axis of the ellipse is made parallel to the center axis of the vibrating diaphragm of the loudspeaker while the width along the major axis of the ellipse is set in the direction orthogonal to the center axis of the vibrating diaphragm. In the elliptical surrounding structure having such a structure, the width in the cross section of the surrounding structure of the loudspeaker can be made narrow in comparison with a semi-circular surround, whereby the linearity of the amplitude and the maximum displacement are increased.

4 Claims, 18 Drawing Sheets

FIG. 13

| inner radius (mm) | outer radius (mm) | angle α (°) | cross sectional width (mm) |
|---|---|---|---|
| 36 | 46 | 38.5 | 5 |
| 97.5 | 121.5 | 36.6 | 12 |
| 118 | 138 | 31.2 | 10 |
| 120 | 140 | 31.0 | 10 |
| 140 | 150 | 21.0 | 5 |
| 140 | 160 | 29.0 | 10 |
| 160 | 180 | 27.3 | 10 |
| 160 | 200 | 36.9 | 20 |
| 180 | 190 | 18.7 | 5 |
| 180 | 200 | 25.8 | 10 |
| 180 | 220 | 35.1 | 20 |
| 240 | 280 | 31.0 | 20 |

FIG. 14

| | minimum resonant frequency (Hz) |
|---|---|
| no groove surround | 73.56 |
| groove without chamfering | 79.48 |
| R of chamfering : 0.1mm | 73.3 |
| R of chamfering : 0.2mm | 71.15 |
| R of chamfering : 0.3mm | 73.19 |
| R of chamfering : 0.4mm | 74.44 |

SURROUNDING STRUCTURE OF A LOUDSPEAKER

BACKGROUND OF THE INVENTION

1. Field of the Invention

The present invention relates to a surrounding structure of a loudspeaker wherein the range of the elastic deformation of the surrounding structure of the loudspeaker, which is a support system for the diaphragm, is widened.

2. Discussion of the Related Art

FIG. 1 is a cross sectional view showing the generic structure of a conventional loudspeaker. The loudspeaker is formed to include a vibrating diaphragm 1, surrounding structure 2, damper 3, voice coil bobbin 4, magnet 5, center pole 6, plate 7, voice coil 8 and frame 10. A magnetic path for magnetic flux formed of the magnet 5, the center pole 6, the plate 7 and a magnetic gap 9 is referred to as a magnetic circuit M.

A specific radius direction of the vibrating diaphragm 1 is located along the X axis and the center axis is located along the Z axis. The surrounding structure 2 of the loudspeaker is an elastic member of an annular structure as seen in the +Z axis direction. The surrounding structure 2 of the loudspeaker has an attaching part 2*a*, attaching part 2*b* and curved part 2*c*. The surrounding structure 2 is secured to the peripheral part of the vibrating diaphragm 1 by means of the attaching part 2*a* provided along the inner periphery of the surrounding structure 2. The surrounding structure 2 is secured to the peripheral part of the frame 10 by means of the attaching part 2*b* provided along the outer periphery of the surrounding structure 2. The form of the cross section of the curved part 2*c* is, in many cases, curved to have a generic hollow and semi-circular form in the cross section of the surrounding structure 2 along a plane including the X axis and the Z axis.

The magnetic flux generated by the magnetic circuit M crosses the voice coil 8 at a portion of the magnetic gap 9. Electromagnetic force occurs when a driving current corresponding to an audio signal is applied to the voice coil 8 in accordance with Fleming's rule so that the vibrating diaphragm 1 vibrates associated with the voice coil bobbin 4 in the Z axis direction. Thus, sound is emitted from the vibrating diaphragm 1 including a dome.

The effective vibration diameter of a diaphragm of the loudspeaker is denoted as A1 as shown in the figure, which is equal to the distance between the right and left center positions of the curved part 2*c* located 180° opposite to each other. Accordingly, the center of the curved part 2*c* of the surrounding structure 2 is positioned A1/2 away from the center of the vibrating diaphragm 1. In general, the effective area of the vibrating diaphragm contributing to the sound pressure characteristics of a loudspeaker is determined by the effective vibration diameter A1.

The damper 3 and surrounding structure 2 constitute a support system for elastically holding the vibrating diaphragm 1 in the Z direction and in the radius direction with a predetermined positioning precision and, at the same time, for regulating the amplitude of the vibration in the upward and downward directions of the vibrating diaphragm 1 and voice coil bobbin 4. The outer periphery of the surrounding structure 2 is secured to the frame 10 using the attaching part 2*b*. The maximum amplitude and the linearity of the amplitude of the vibration in the upward and downward directions of the vibrating diaphragm 1 are determined by the elasticity characteristics and viscosity characteristics (damping characteristics), which are the characteristics of the damper 3 and surrounding structure 2.

The efficiency of a loudspeaker becomes higher as the effective vibration diameter A1 becomes greater. It is necessary to make the width (hereinafter, referred to as cross sectional width) of the curved part 2*c* of the surrounding structure 2 narrower in the radius direction for expansion of the diameter of the vibrating diaphragm while maintaining the same outer diameter of the loudspeaker in order to increase the efficiency of the loudspeaker.

The radius of curvature of the curved part of the surrounding structure 2 of the loudspeaker, wherein the cross section of the curved part is in a semi-circular form, can be reduced in order to narrow the width of the surrounding structure 2. According to this method, change in shape of the surrounding structure 2 following the vibration in the upward and downward directions of the vibrating diaphragm 1 and voice coil bobbin 4 becomes difficult. In this case, the maximum amplitude of the surrounding structure 2 and vibrating diaphragm 1 becomes smaller and the linearity of amplitude of the elastic deformation of the surrounding structure 2 reduces significantly. At the same time, the stiffness of the surrounding structure 2 increases and, therefore, the maximum sound pressure of the loudspeaker is prevented from increasing, and the lowest resonant frequency of the loudspeaker becomes higher. Therefore, reproduction of the low frequency range of sound becomes difficult and the sound quality deteriorates.

SUMMARY OF THE INVENTION

The present invention relates to a surround, which is used in a loudspeaker having a vibrating diaphragm and a frame, having a structure wherein the outer periphery is secured to the frame while the inner periphery is secured to the diaphragm and wherein a curved part encircles the outer periphery of the vibrating diaphragm, and the present invention is particularly characterized by the form of the surrounding structure of the loudspeaker.

The cross section of the curved part along the radius direction of the vibrating diaphragm of the surrounding structure of the loudspeaker according to the present invention is in a hollow and approximately semi-elliptical form. The ratio of a width along the minor axis of the ellipse, from the vertex of the ellipse to an inner end of the outer periphery of the surrounding structure of the loudspeaker, to a height along the major axis of the ellipse, from the vertex of said ellipse to a surface of the outer periphery of the surrounding structure of the loudspeaker, is at least 1.14. The major axis of the ellipse is parallel to the center axis of the vibrating diaphragm, and the minor axis of the ellipse is in the direction orthogonal to the center axis of the vibrating diaphragm.

In the surrounding structure of the loudspeaker of the present invention, grooves may be formed by means of a plastic deformation of the surrounding structure of the loudspeaker material along line segments connecting a point P1 around the inner periphery of the curved part and a point P2 around the outer periphery of the curved part. The plurality of grooves may be formed along the outer peripheral portion of the diaphragm.

In the surrounding structure of the loudspeaker of the present invention, a plurality of grooves may be formed by means of a plastic deformation of the surrounding structure of the loudspeaker material along line segments connecting a point Q1 along the inner periphery of the curved part and a point Q2 along the outer periphery of the curved part, wherein the point Q1 and the point Q2 are located in the same radius.

BRIEF DESCRIPTION OF THE DRAWINGS

FIG. 13 is a table showing the value of angle $\alpha$ when the inside radius of the surrounding structure of the loudspeaker and the outside radius of the surrounding structure of the loudspeaker are varied;

FIG. 14 is a table describing change in the lowest resonant frequency according to a parameter of the radius of curvature in grooves of the surrounding structure of the loudspeaker in the case where the radius R of curvature in chamfering of the grooves is varied and in the case where no grooves are provided;

DETAILED DESCRIPTION OF THE PREFERRED EMBODIMENTS

Surrounding structures of a loudspeaker according to embodiments of the present invention will be described with reference to FIGS. 2 to 18. Here, the same names are attached to the same components as of the conventional loudspeaker shown in FIG. 1 and the descriptions thereof will not be repeated.

(First Embodiment)

Figure 2:
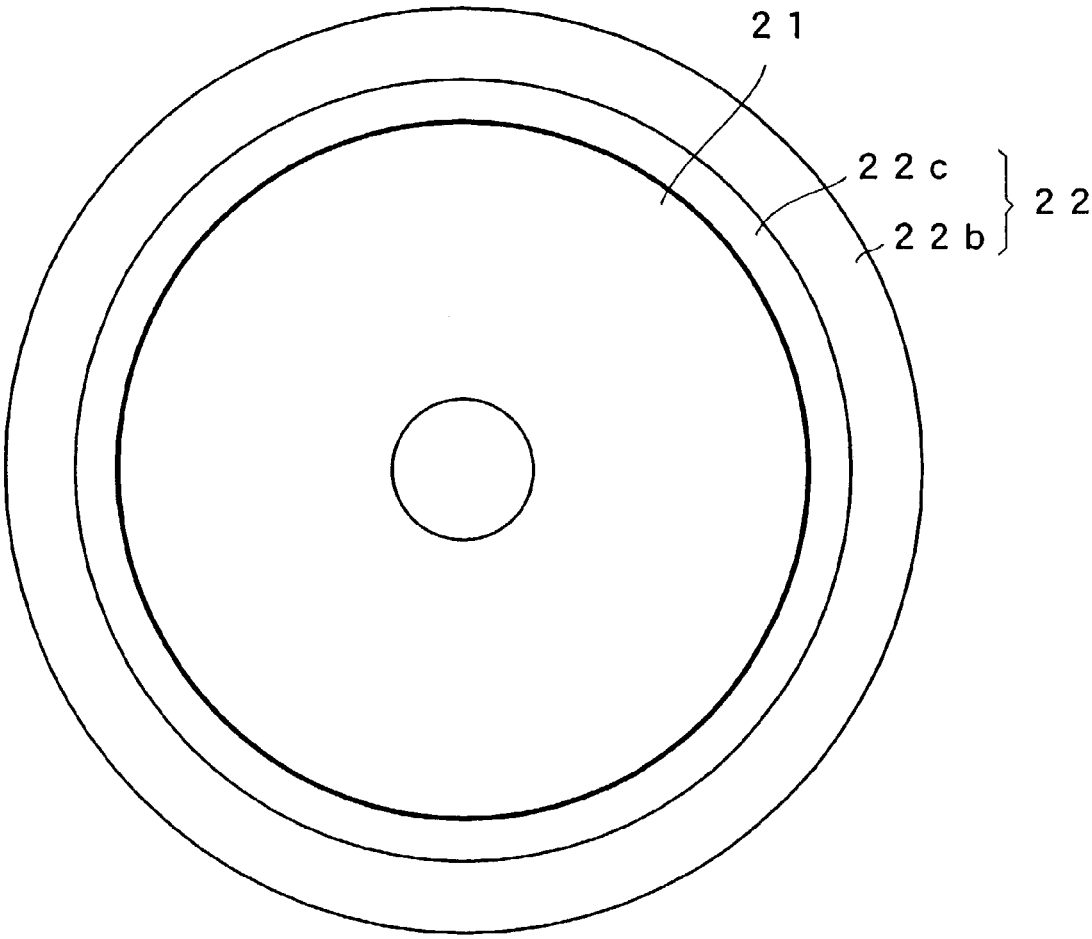
FIG. 2 is a plan view of a surrounding structure of a loudspeaker according to a first embodiment of the present invention.
Figure 3:
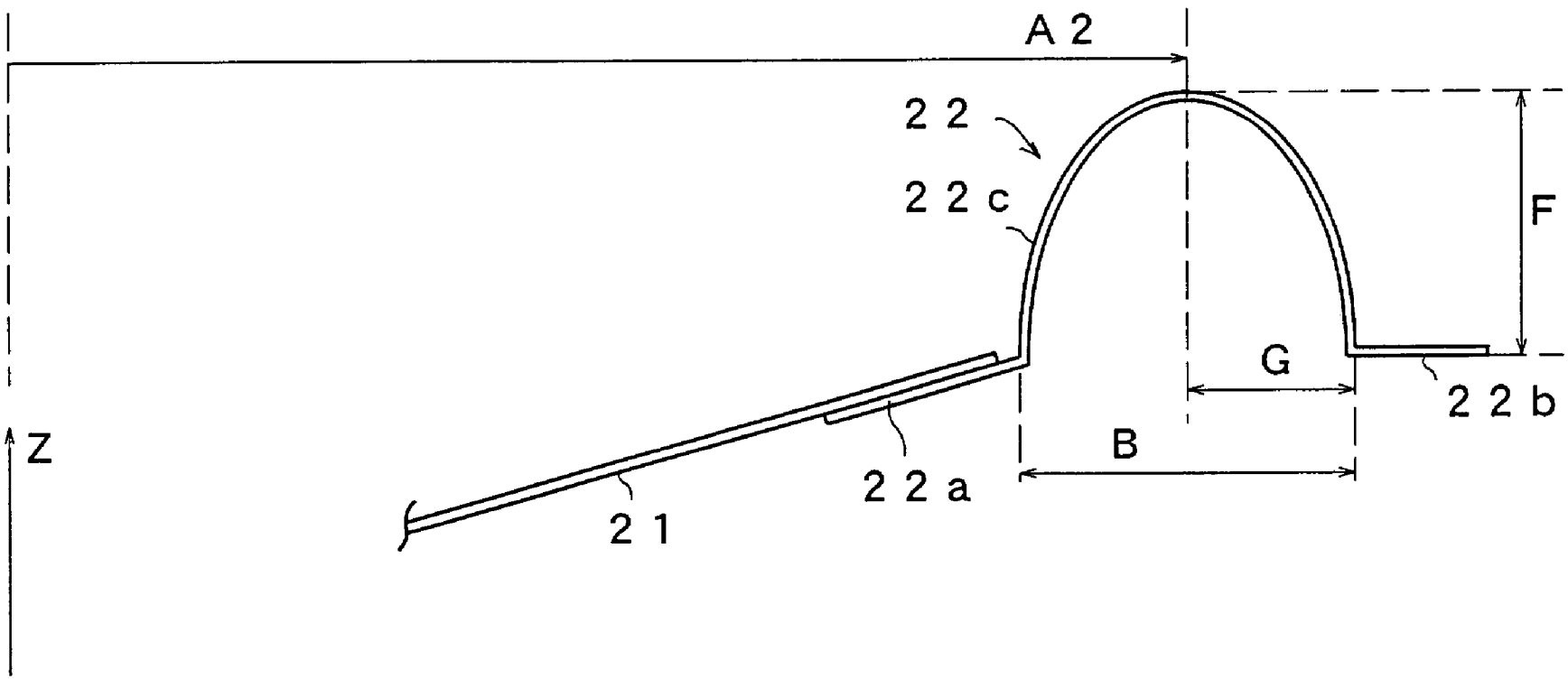
FIG. 3 is a cross sectional view of the main portion of the surrounding structure of the loudspeaker according to the first embodiment.
Figure 4:
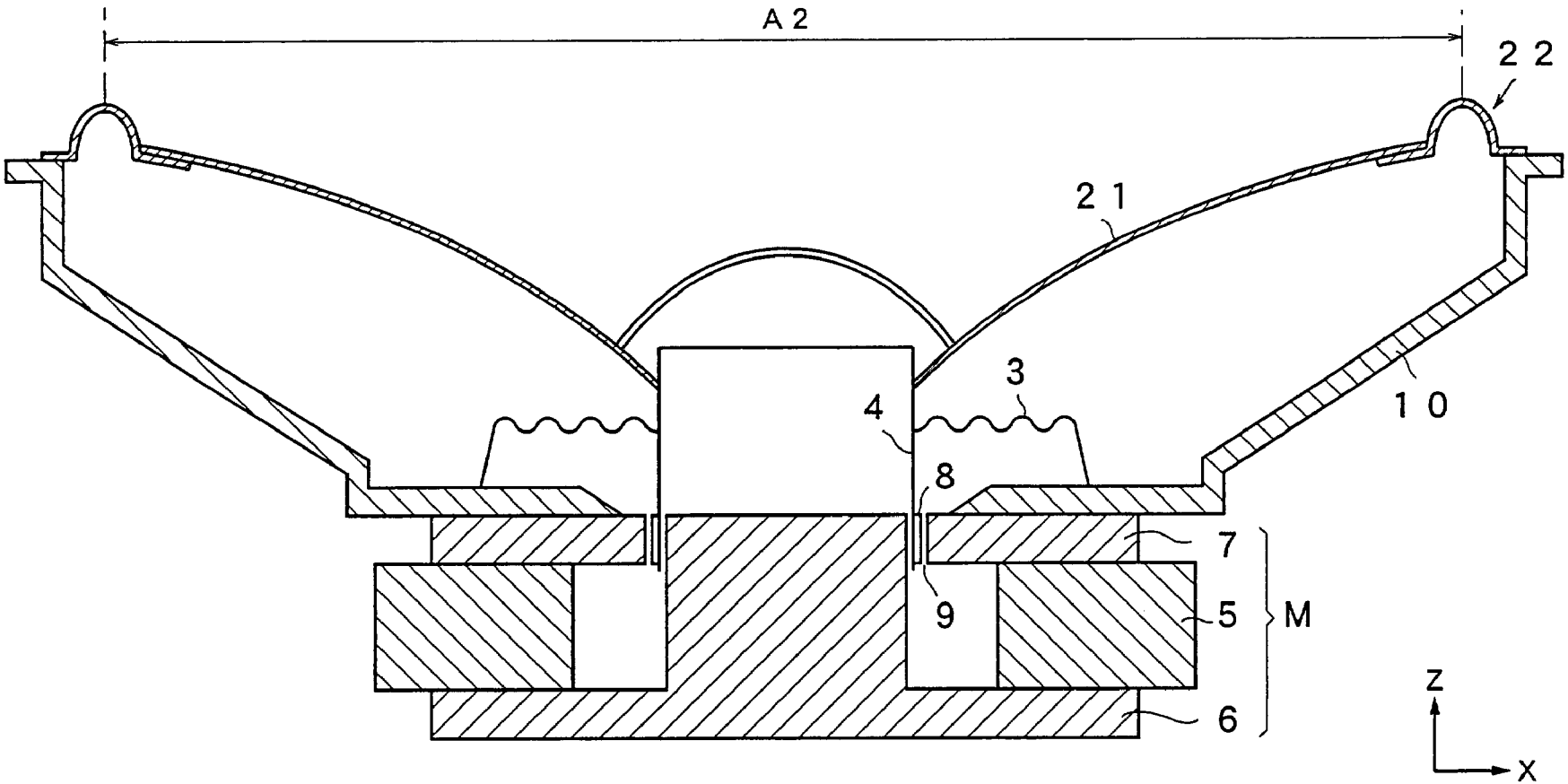
FIG. 4 is a cross sectional view showing the structure of the main portion of the loudspeaker wherein the elliptical surrounding structure according to the first embodiment is used.

A surrounding structure of a loudspeaker according to a first embodiment of the present invention will be described with reference to the drawings. FIG. 2 is a plan view showing the structures of the surrounding structure of the loudspeaker and the vibrating diaphragm of the loudspeaker according to the first embodiment of the present invention, and FIG. 3 is a cross sectional view showing the structure of the main portion of the surrounding structure of the loudspeaker. FIG. 4 is a cross sectional view showing the structure of the main portion of the loudspeaker wherein the surrounding structure of the loudspeaker of the present embodiment is used. The components of the loudspeaker other than a surrounding structure 22 in FIG. 4 are the same as those shown in FIG. 1 and, the descriptions thereof will not be repeated.

Figure 1:
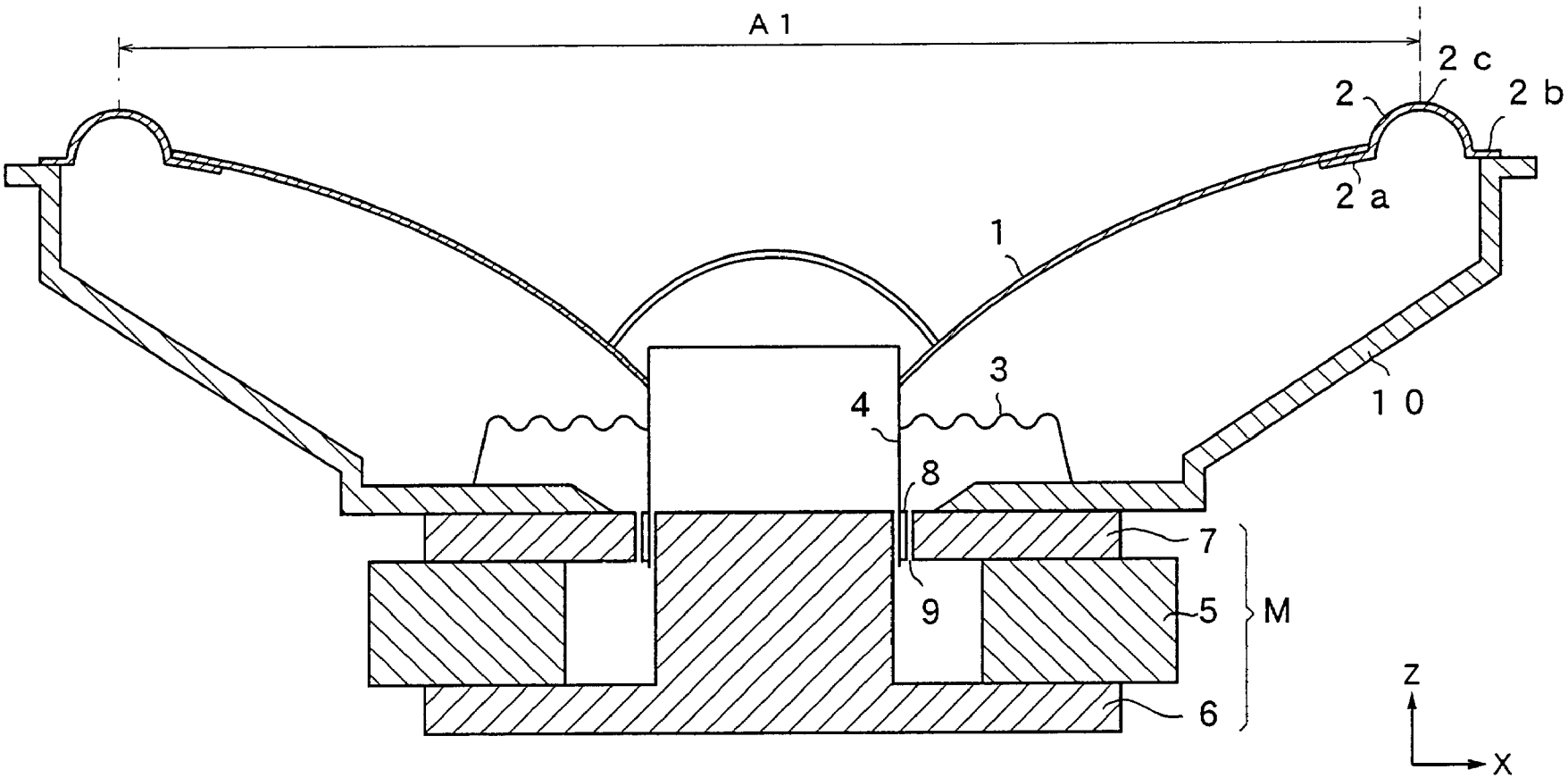
FIG. 1 (PRIOR ART)
FIG. 1 is a cross sectional view showing the structure of the main portion of a loudspeaker according to a prior art.

The loudspeaker shown in FIG. 4 is characterized in that the structure of the surrounding structure of the loudspeaker from among the components shown in FIG. 1 has been modified. As shown in FIG. 3, the surrounding structure of the loudspeaker is integrally formed in an annular form of an attaching part 22*a*, attaching part 22*b*, and curved part 22*c*. The effective vibration diameter of the loudspeaker is denoted as A2 in the figure. The effective vibration diameter A2 is the distance between the center positions of the curved part 22*c* of the surrounding structure of the loudspeaker located 180° opposite to each other. Accordingly, the vertex of the curved part 22*c* is positioned A2/2 away from the center of the vibrating diaphragm 21. B in the figure is referred to as the cross sectional width of the curved part 22*c*. Here, Z indicates the direction of vibration of the vibrating diaphragm 21.

The surrounding structure of the loudspeaker has an annular structure wherein the curved part 22*c* encircles the outer periphery of the vibrating diaphragm 21. In addition, the cross section of the curved part 22*c* along the direction of a diameter of the vibrating diaphragm 21 is characterized by being in a hollow and approximately semielliptical form, wherein the major axis of the ellipse is parallel to the center axis of the vibrating diaphragm 21, and height F represents the distance between the vertex of the ellipse and the bottom surface of the attaching part 22*b*. The minor axis of the ellipse is set in the direction orthogonal to the center axis of the vibrating diaphragm 21, and width B represents the distance between the vertex of the ellipse and the inner end of the attaching part 22*b*. Such a surrounding structure is referred to as an elliptical surrounding structure. The attaching part 22*a* is secured to the outer periphery portion of the vibrating diaphragm 21 and the attaching part 22*b* is secured to the frame 10, whereby the vibrating diaphragm 21 is supported so as to freely vibrate.

The operation of the loudspeaker having such elliptical surrounding structure will be described. When a driving current corresponding to an audio signal is applied to the voice coil of this loudspeaker, the vibrating diaphragm 21 secured to the voice coil bobbin vibrates in the Z direction. The surrounding structure of the loudspeaker is secured to the outer periphery portion of the vibrating diaphragm 21 via the attaching part 22*a* while the attaching part 22*b* of the surrounding structure of the loudspeaker supports the frame 10, whereby the vibration of the vibrating diaphragm 21 is regulated. That is to say, without the surrounding structure of the loudspeaker, the vibrating diaphragm 21 does not necessarily vibrate in the Z direction, wherein the normal status is maintained.

As the driving current of the voice coil 8 is increased, the amplitude of the vibration of the vibrating diaphragm 21 increases. At this time, the displacement of the elliptical surrounding structure also increases due to the expansion of the curved part 22*c*. The vibrating diaphragm 21 cannot vibrate with an amplitude greater than that when the displacement of the curved part 22*c* reaches the limit. The amplitude of the vibrating diaphragm 21 in the Z direction at this time is referred to as the maximum displacement.

The cross section of the curved part 22*c* is in a hollow and approximately elliptical form, whereby the cross sectional width B of the curved part 22*c* can be reduced and the effective vibration diameter A2 of the loudspeaker can be increased, without exceeding the limit of the elastic deformation and without change in the length of the external diameter (A2+B) of the surrounding structure of the loudspeaker. The efficiency of a loudspeaker is proportional to the effective vibration area and, therefore, the efficiency of the loudspeaker can be increased by increasing the effective vibration diameter A2.

Figure 5:
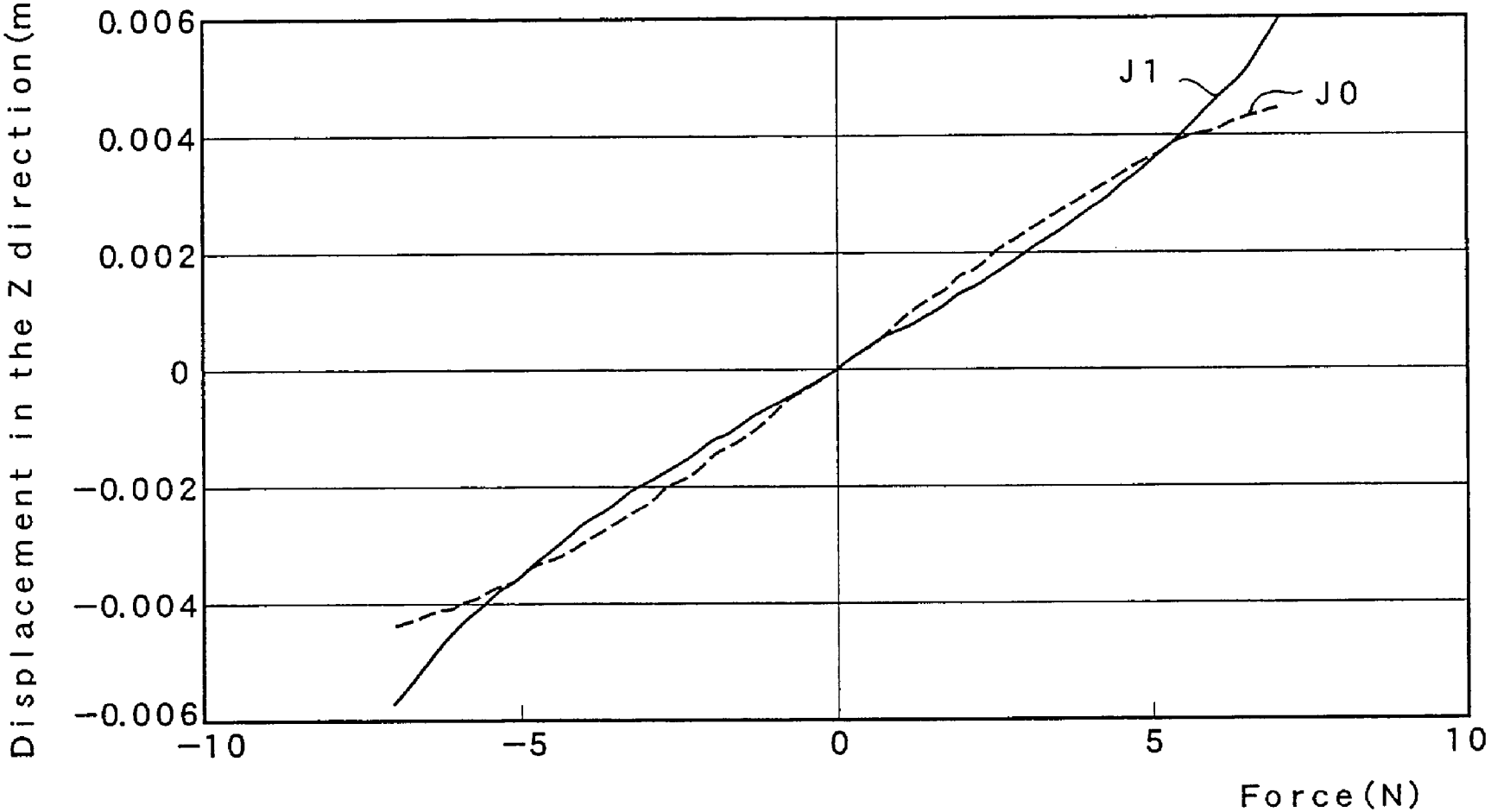
FIG. 5 is a characteristics graph showing the relationships between the forces and the displacements in the elliptical surrounding structure according to the first embodiment and in a semi-circular surrounding structure according to the prior art.

FIG. 5 is a characteristics graph showing the relationships between the force applied to the surrounding structure of the loudspeaker and the displacement. The lateral axis indicates the force [N] in the Z direction and the longitudinal axis indicates the displacement [m] in the Z direction. This graph shows the relationships between the force and the displacement of a conventional surrounding structure (hereinafter, referred to as semi-circular surrounding structure J0) of which the cross section of the curved part is in a semi-circular form and between the force and the displacement of the elliptical surrounding structure J1 according to the present embodiment while the cross sectional width B of the curved part 22*c* is the same in both of the surrounding structure of the loudspeakers of the graph.

The maximum displacement of the elliptical surrounding structure J1 is significantly greater than that of the semi-circular surrounding structure J0. This is because, in the case where the curved part is in an elliptical form, the length along the surface of the material of the curved part in the cross section becomes great so that the amount of expansion at the time of deformation can be increased.

In the case where the cross section of the curved part is in a semi-circular form, the maximum displacement decreases as described above when the cross sectional width B of the curved part is further reduced in order to increase the efficiency of the loudspeaker. This results in a smaller maximum sound pressure and the performance of the loudspeaker deteriorates. The efficiency of the loudspeaker can be increased without reduction in the maximum displacement or in the maximum sound pressure by selecting an elliptical form for the cross section of the curved part.

Figure 6:
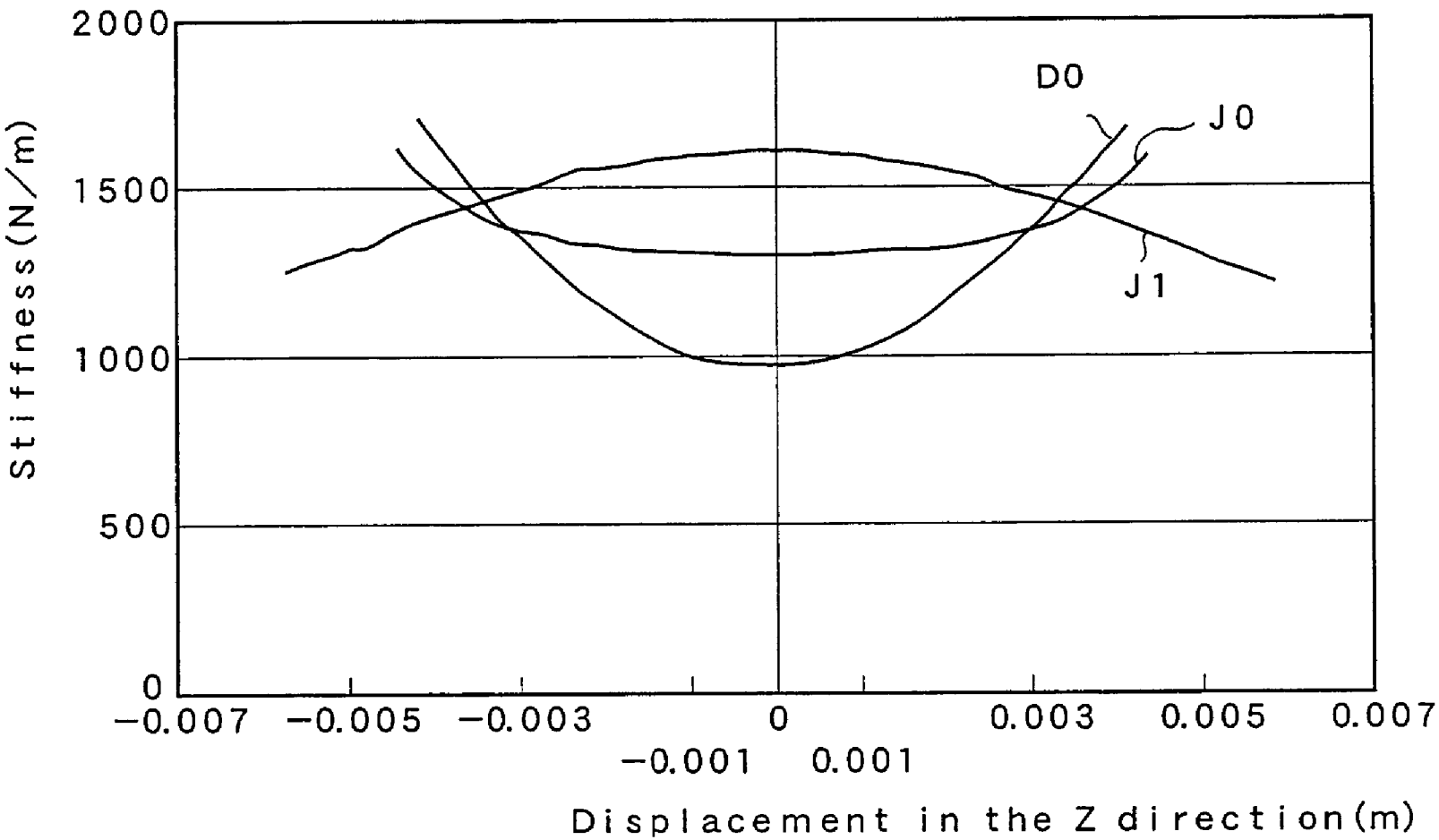
FIG. 6 is a characteristics graph showing the relationships between the displacement and the stiffness in an elliptical according to the first embodiment, in the semi-circular surrounding structure according to the prior art and in a conventional damper.

FIG. 6 is a graph describing the stiffness characteristics of the surrounding structure of the loudspeakers and a damper. The lateral axis indicates the displacement [m] of a surrounding structure or of a damper in the Z direction while the longitudinal axis indicates the stiffness [N/m]. The present graph shows the stiffness characteristics of the elliptical surrounding structure J1, the stiffness characteristics of the semi-circular surrounding structure J0 that has the same cross sectional width as the elliptical surrounding structure J1, and the stiffness characteristics of the damper D0 of a common waveform, respectively.

The stiffness of the semi-circular surrounding structure J0 and damper D0 increases as the amplitude of vibration increases. That is to say, the movements of the semi-circular surrounding structure J0 and damper D0 as support members of the vibrating diaphragm lose smoothness so that the amplitude of vibration is regulated.

The characteristics of the elliptical surrounding structure J1 show the opposite tendency to the characteristics of the semi-circular surrounding structure J0 and of the damper D0. The surrounding structure of the loudspeaker does not move smoothly when the amplitude of vibration is small indicating that the stiffness becomes smaller as the amplitude of vibration becomes closer to the maximum value. That is to say, the elliptical surrounding structure J1 becomes to move smoothly in a region wherein the amplitude of vibration is great. The characteristics of the entire vibration system concerning the stiffness are determined by the total characteristics of the surrounding structure of the loudspeaker and damper. Accordingly, the linearity of the total stiffness can be improved by using the elliptical surrounding structure J1 having stiffness characteristics opposite to the damper. Thereby, the loudspeaker having an improved linearity of the amplitude and having a lower distortion can be implemented. Accordingly, the loudspeaker has high sound quality under the condition wherein the effective vibration diameter is maintained within a tolerable range.

Figure 7:
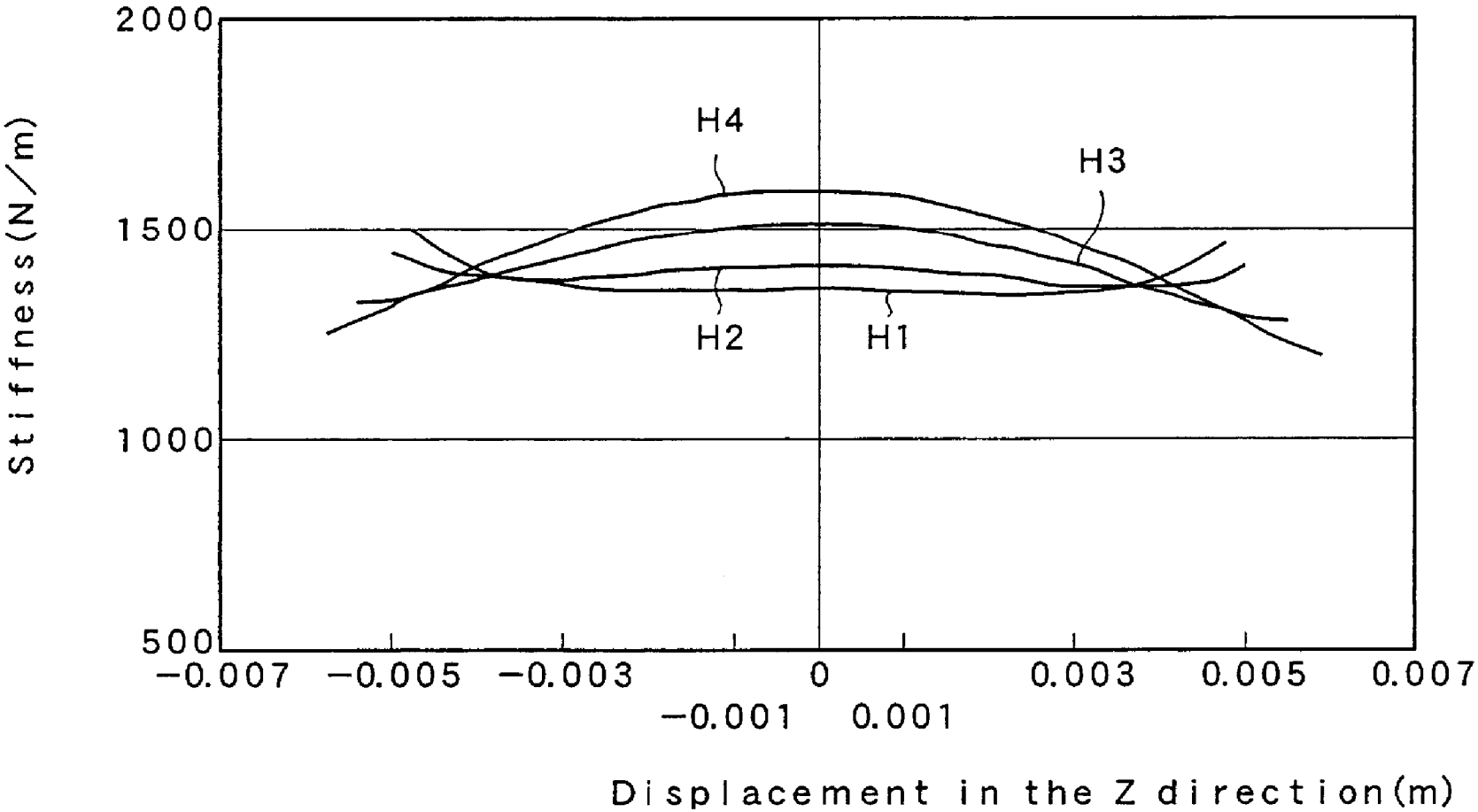
FIG. 7 is a characteristics graph showing the relationships between the displacement and the stiffness when the ratio of the height F along the major axis to the width G along the minor axis is varied in the elliptical surrounding structure according to the first embodiment.

FIG. 7 is a graph describing the characteristics of elliptical surrounds concerning the stiffness according to parameters of the height F and width G of the curved part 22*c*. The longitudinal axis of FIG. 7 indicates the stiffness [N/m] while the lateral axis indicates the displacement [m] of the surrounding structure of the loudspeaker in the Z direction. The stiffness characteristics of the elliptical surrounding structure wherein the curved part has the same cross sectional width B are shown in the case where the ratio of the width G to the height F is varied. In the figure, H1 indicates the stiffness characteristics in the case where G:F is 3.5:3.8, H2 indicates the stiffness characteristics in the case where G:F is 3.5:4.0, H3 indicates the stiffness characteristics in the case where G:F is 3.5:4.5, and H4 indicates the stiffness characteristics in the case where G:F is 3.5:5.0.

It is necessary for the stiffness characteristics of an elliptical surrounding structure to be inverted from the stiffness characteristics of a damper from the point of view of an entire improvement of the loudspeaker in the linearity of the amplitude. The cases where the loudspeaker has such characteristics are the cases where G:F is 3.5:4.0 as in H2 or greater, that is to say, the cases of H2, H3 and H4. Accordingly, the effective range of the ratio of the width along the minor axis to the height along the major axis of the ellipse is 3.5:4.0 or greater, that is to say, 1.0:1.14 or greater.

According to the surrounding structure of the loudspeaker having the above described structure, the cross sectional width of the curved part can be reduced and the effective vibration diameter can be increased so that the efficiency of the loudspeaker can be increased in comparison with a conventional loudspeaker having the same diameter. Thereby, the maximum displacement is not reduced and the linearity of the amplitude of the loudspeaker is improved so that the sound quality can be improved.

(Second Embodiment)

Figure 8:
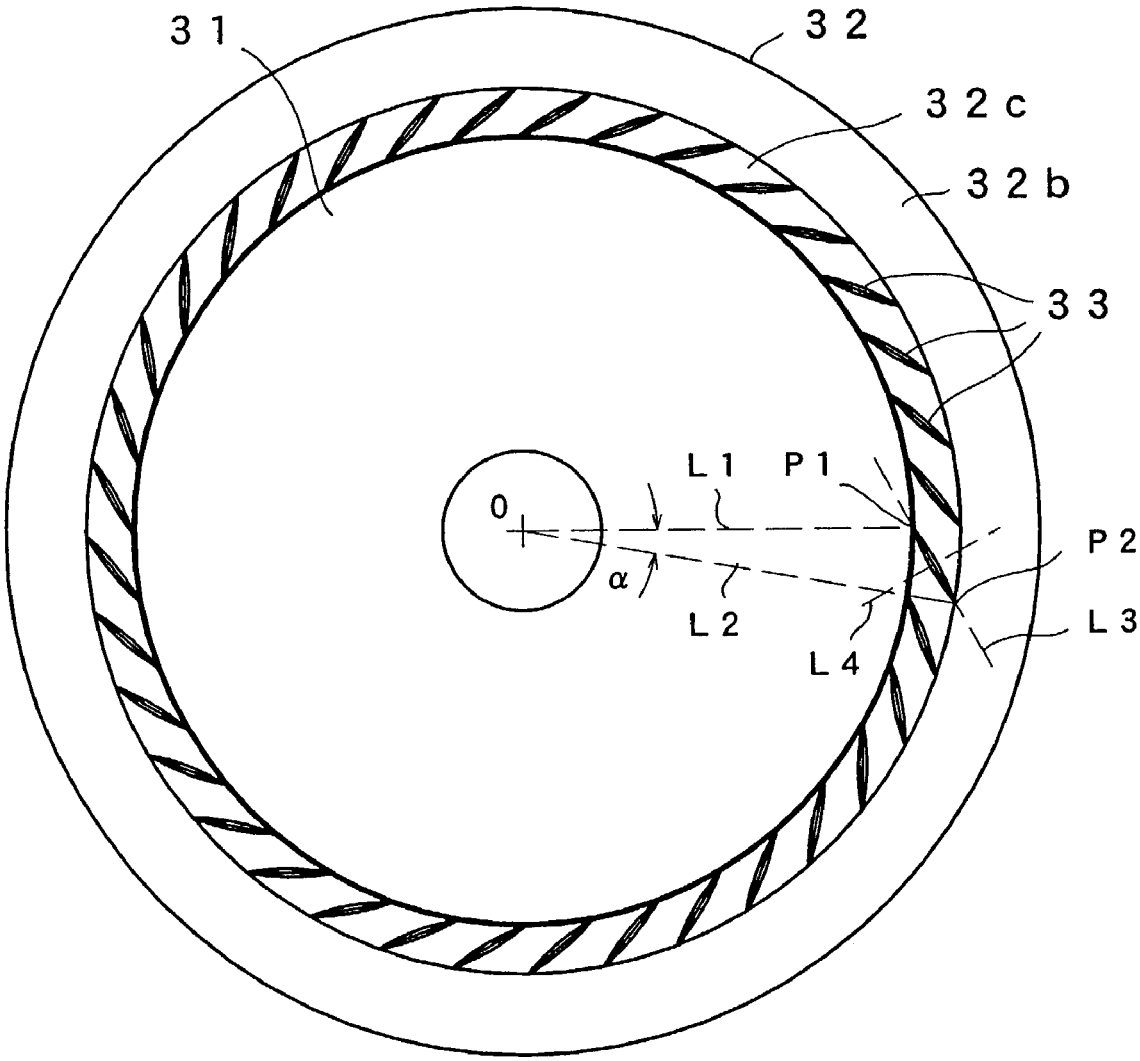
FIG. 8 is a plan view of a surrounding structure of a loudspeaker according to a second embodiment of the present invention.
Figure 9:
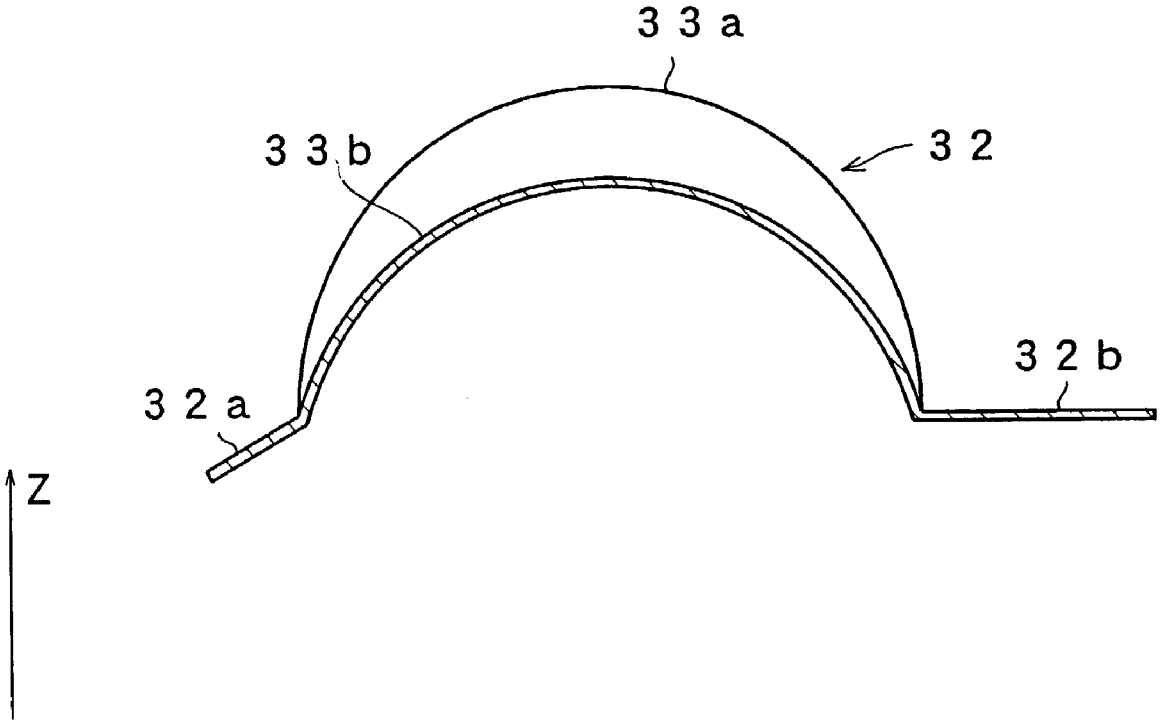
FIG. 9 is a cross sectional view showing the structure of the main portion of the surrounding structure of the loudspeaker according to the second embodiment.
Figure 10:
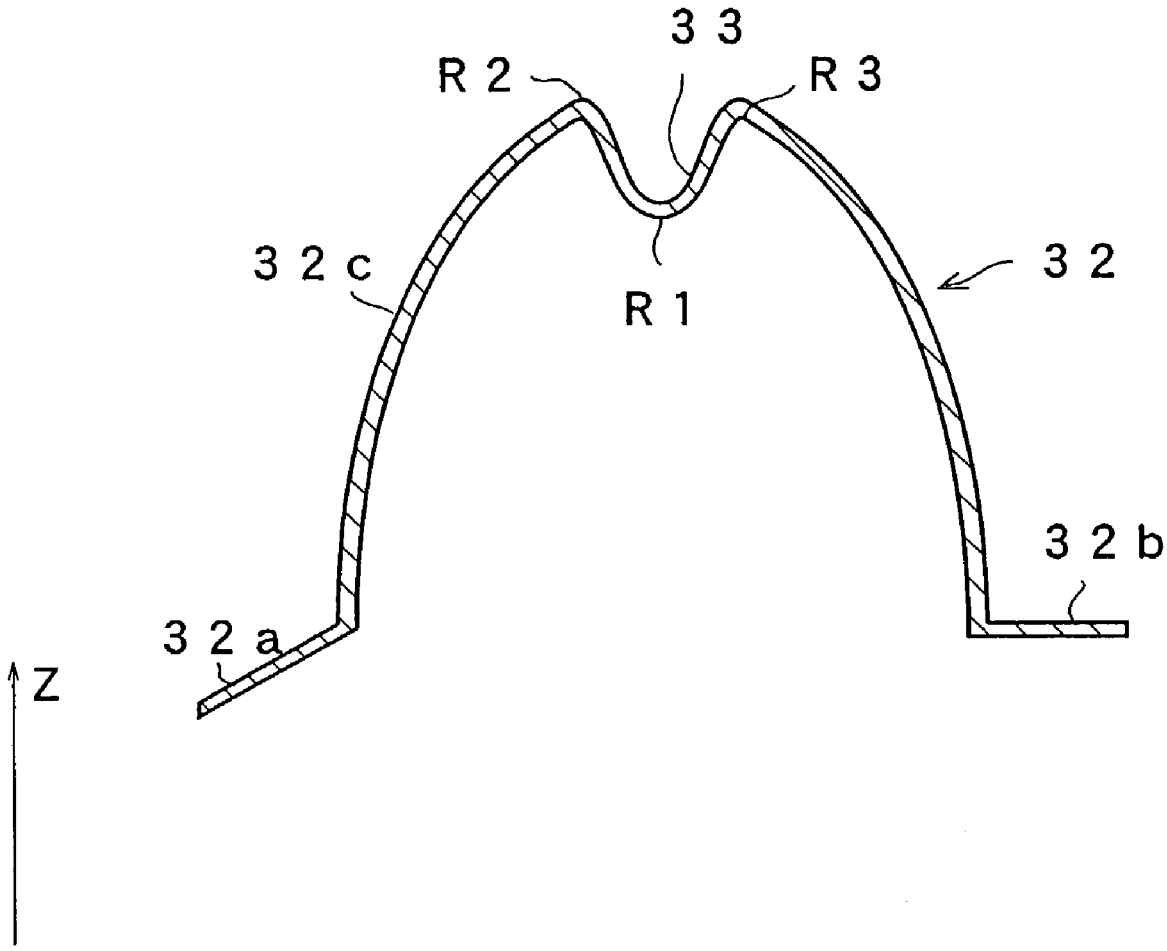
FIG. 10 is a cross sectional view showing the structure of the main portion of the surrounding structure of the loudspeaker according to the second embodiment.

Next, a surrounding structure of a loudspeaker according to the second embodiment of the present invention will be described. FIG. 8 is a plan view showing the structure of the surrounding structure of the loudspeaker and the vibrating diaphragm of a loudspeaker according to the second embodiment. FIG. 9 shows the structure of the main portion of the surrounding structure of the loudspeaker according to the second embodiment and is a cross sectional view along a groove. FIG. 10 is a cross sectional view of the surrounding structure of the loudspeaker in the case where the cross section is taken along the line perpendicular to the direction of the groove. The surrounding structure of the loudspeaker of the present embodiment is characterized by an elliptical surrounding structure such as of the first embodiment and, in addition, is characterized in that a great number of grooves are provided in the curved part in the tangential direction of the vibrating diaphragm. The remaining parts in the configuration are the same as those in the first embodiment.

As shown in FIG. 8, a surrounding structure 32 having grooves secured to the outer periphery portion of a vibrating diaphragm 31 of this loudspeaker. The surrounding structure of the loudspeaker 32 of the present embodiment has, in the same manner as that in first embodiment, an attaching part 32*a*, an attaching part 32*b* and a curved part 32*c*, wherein the cross section of the curved part 32*c* along the direction of a diameter of the vibrating diaphragm 31 is in a hollow and approximately semi-elliptical form. Thus, the major axis of the ellipse is parallel to the center axis of the vibrating diaphragm 31 the minor axis of the ellipse is set in the direction orthogonal to the center axis of the vibrating diaphragm 31.

As shown in FIG. 8, O denotes the center of the vibrating diaphragm 31, P1 (first point) denotes one point on the inner periphery of the curved part 32*c* and P2 (second point) denotes one point on the outer periphery of the curved part 32*c*. In addition, L1 denotes the line connecting center O and the point P1, L2 denotes the line connecting center O and the point P2 and $\alpha$ denotes an angle formed between the lines L1 and L2. Next, a groove 33 is formed along a line L3 connecting the points P1 and P2 by plastic deformation of the material of the surrounding structure of the loudspeaker 32. A plurality of grooves, each of which is the same as this groove 33, is preferably provided at equal intervals so as to be arranged along the outer periphery portion of the vibrating diaphragm 31.

The angle $\alpha$ indicating the direction of the grooves 33 differs depending on the dimensions of the outer diameter of the vibrating diaphragm and on the number of grooves provided and is a range of from greater than 0° to no greater than 40°. The sectional figure of the groove 33 in the case where the cross section is taken along a normal line L4 orthogonal to the line L3 is a U-shape or V-shape, as shown in FIG. 10. In the case where the cross section of a groove 33 is taken along the line L3 of FIG. 8, a ridge portion 33*a* of the groove 33 agrees with the outline of the curved part 32*c* of the surrounding structure of the loudspeaker 32. In addition, a bottom portion 33*b* is the valley of the groove 33.

In the cross sectional view of the surrounding structure of the loudspeaker 32, shown in FIG. 10 where the cross section of the groove 33 is posited to be in a U-shape, the radius of curvature of the ridge portion 33*a* and of the bottom portion 33*b* of the groove 32 is denoted by the symbol R. The radius of curvature of the bottom portion 33*b* of the groove 33 is R1 and the radii of curvature of the ridge portions 33*a* are R2 and R3. When the curved part 32*c* is formed, the grooves 33 are formed simultaneously according to plastic deformation of the material of the surrounding structure of the loudspeaker 32. This formation method differs depending on the material. Pressure formation by means of a die is used in the case of, for example, a rubber sheet, a sheet material, such as of a cloth into which rubber is filed, or a film material made of a resin. In the case where the material of the surrounding structure of the loudspeaker is resin, melt injection formation is used. The radii of curvature in these processes are set at values that can prevent the material from suffering elastic fatigue and from being ruptured at these corner portions as a result of repeated application of a local force to the material. The radii of the curvature R1, R2 and R3 are set at values in a range of, for example, from 0.1 (mm) to 0.3 (mm) taking the cross sectional width and the thickness of the material in the curved part into consideration. Such curved regions are referred to as chamfering region.

A hollow and approximately elliptical form is selected for the cross section of the curved part of the surrounding structure of the loudspeaker 32 in the same manner as in the case of the first embodiment, whereby the cross sectional width B of the curved part can be reduced and the effective vibration diameter A2 can be increased without allowing the elastic deformation to exceed the limit and without changing the dimensions of the outer diameter of the surrounding structure of the loudspeaker. The efficiency of a loudspeaker is proportional to the effective vibration area determined by the effective vibration diameter, whereby the efficiency of the loudspeaker increases.

Figure 11:
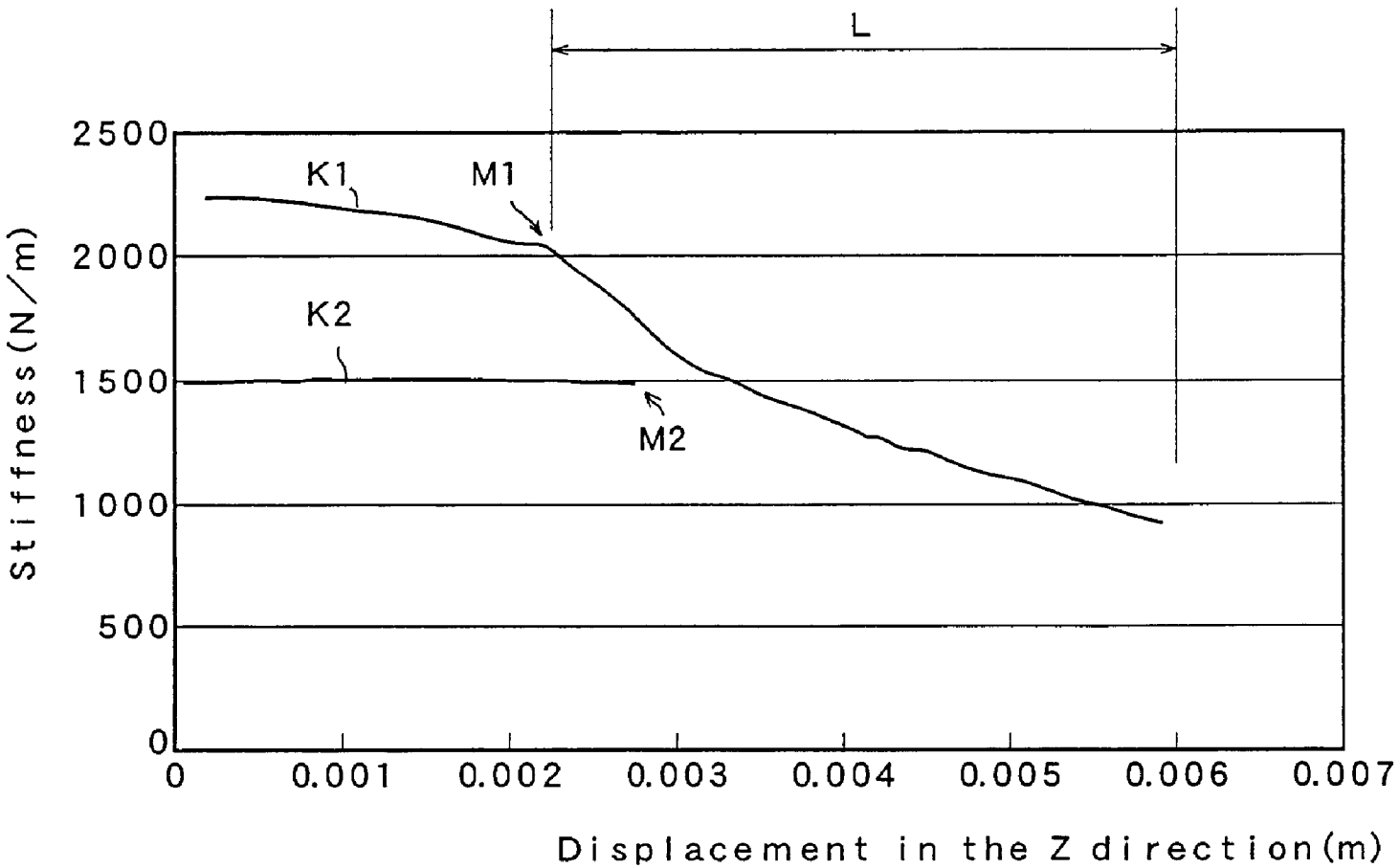
FIG. 11 is a characteristics graph showing the relationships between the displacement of surrounds with and without grooves and the stiffness in the surrounding structure of the loudspeaker according to the second embodiment.

FIG. 11 is a graph describing a comparison of stiffness characteristics of elliptical surrounds with and without grooves. The lateral axis indicates the displacement [m] in the Z direction and the longitudinal axis indicates the stiffness [N/m]. The characteristics of the elliptical surrounding structure in the case where no grooves are provided are denoted as K1. The characteristics of the elliptical surrounding structure in the case where grooves are provided are denoted as K2. A region L indicates a range where stiffness characteristics sharply change in the elliptical surrounding structure without grooves. This sharp change occurs when force N in the Z direction is increased so that the amount of deformation of the curved part reaches the limit and, then, the form of diaphragm itself, which is secured to the inner periphery portion of the surrounding structure of the loudspeaker, changes. Accordingly, the maximum displacement is represented by the value of point M1 at the left edge of region L and the maximum displacement in this example is 0.002 m.

The grooves 33 having the above described structure are provided, whereby the material of the grooves 33 extends in the direction of the normal line L4 so that the elastic deformation of the curved part 32*c* can be increased. Therefore, the grooves 33 ease the state when suspension is spread to limitation of transformation and increases maximum displacement to the point M2 from the point M1 as shown in FIG. 11. In this example, the displacement at the point M2 has a value close to 0.003 m. That is to say, the half amplitude increases by approximately 1 mm.

On the other hand, in the case where an elliptical surrounding structure having no grooves as shown in FIG. 3 is used in order to expand the effective vibration diameter, the minimum resonant frequency of the loudspeaker rises. The grooves 33 are provided in the elliptical surrounding structure in order to lower the minimum resonant frequency. The grooves 33 also contribute to restrict rise in the stiffness of the surrounding structure of the loudspeaker 32.

The range that the stiffness of the elliptical surrounding structure with grooves does not change is wide, as shown by characteristics K2 of FIG. 11. Therefore, a surrounding structure of a loudspeaker having an excellent linearity characteristics can be obtained. As described above, the characteristics of the stiffness of the entire loudspeaker using an elliptical surrounding structure with grooves improves significantly in comparison with the characteristics of a loudspeaker using a conventional semi-circular surrounding structure.

Here, though the number of the grooves 33 is 36 according to the illustration of FIG. 8, the number of grooves is arbitrary. The designer or manufacturer of the loudspeaker can select the number of grooves and the form thereof, as well as the manner of arrangement of the grooves, taking feasibility of the formation, linearity of the amplitude, maximum displacement and minimum resonant frequency of the loudspeaker into consideration.

Figure 12:
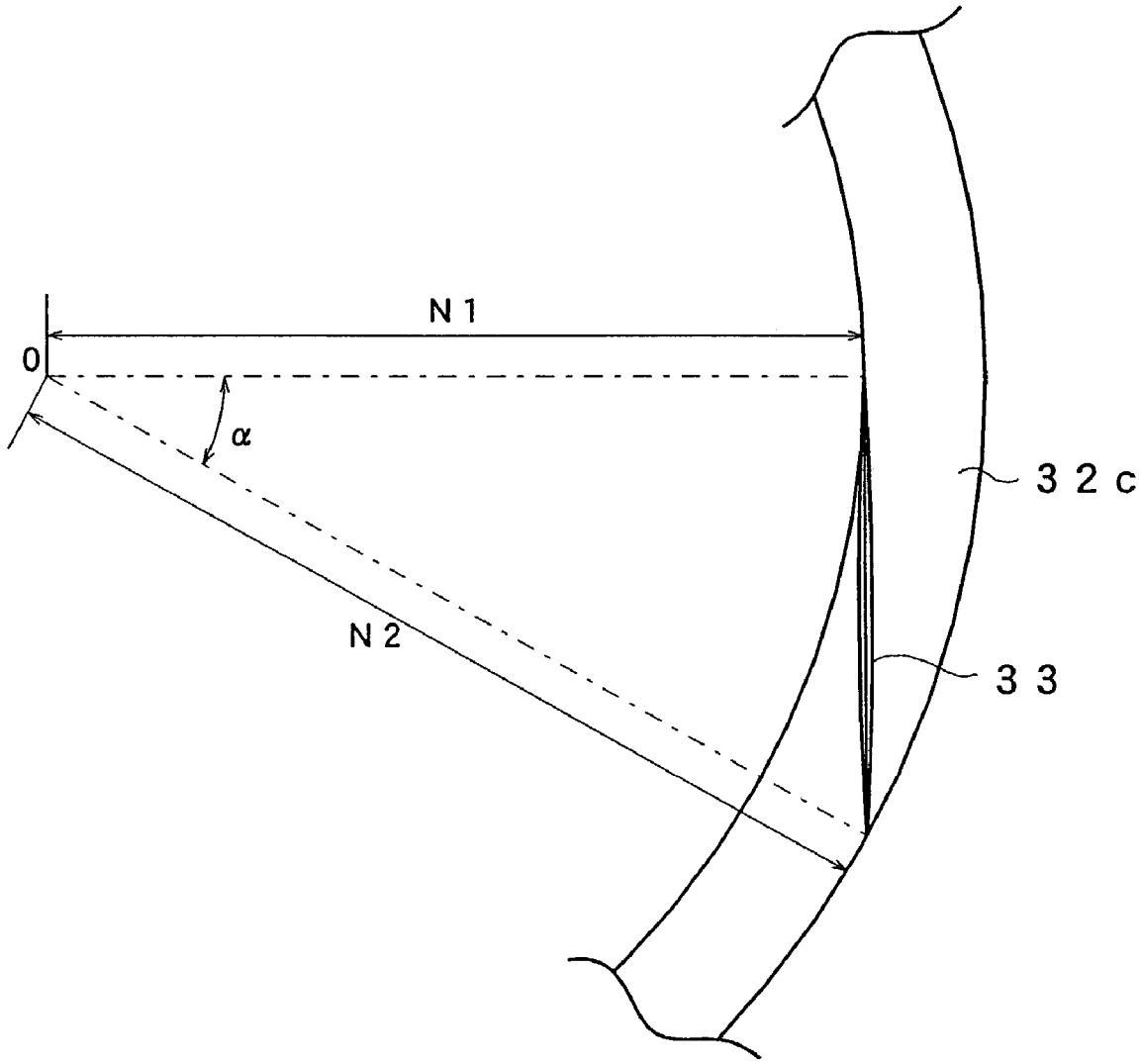
FIG. 12 is a diagram describing the relationship among center angle $\alpha$, and inside and outside radii of the curved part in the surrounding structure of the loudspeaker according to the second embodiment.

FIG. 12 is a diagram describing the relationship among the angle α, the inner radius N1 of the curved part, and the outer radius N2 of the curved part. The condition that α becomes the largest is that the center line of the groove 33 makes contact with the inner periphery of the curved part. In this condition, α is represented in the following equation (1):

$$\alpha=\cos^{-1}(N1/N2) \quad (1)$$

The cross sectional width B of the curved part is 20 mm or less in a general loudspeaker having a diameter of from 80 mm to 300 mm. FIG. 13 shows the relationships between the value of the angle α and the cross sectional width when the cross sectional width of the curved part is 5 mm to 20 mm and when inner radius of the surrounding structure N1 of the curved part and outer radius of the surrounding structure N2 of the curved part are varied.

A loudspeaker wherein α exceeds 40° is a specific loudspeaker having an extremely large width of a surrounding structure and is not a subject matter of the present invention wherein the efficiency is increased by expanding the effective vibration diameter of a diaphragm according to the object thereof. Therefore, the angle α is in a range of greater than 0° and no greater than 40° for the grooves.

FIG. 14 is a table showing examples of which the minimum resonant frequency of the vibrating diaphragm and the surrounding structure of the loudspeaker is varied in the case where the radius R of curvature of each chamfering of the groove is changed from 0.0 mm to 0.4 mm and in the case where no grooves are provided. According to this table, the minimum resonant frequency in the case where the radius R of curvature of each chamfering of the groove is 0 mm (without chamfering) is higher than in the case where no grooves are provided. That is to say, the stiffness of the curved part rises and the movement thereof loses smoothness so that the maximum displacement is lowered when there is no chamfering.

The minimum resonant frequency stands at the minimum value in FIG. 14 when the radius R of curvature of each chamfering of a groove is 0.2 mm. That is to say, the stiffness of the curved part in the surrounding structure of the loudspeaker becomes the minimum so that the movement of the curved part becomes smooth. When the radius R of curvature of each chamfering of a groove is 0.4 mm, the minimum resonant frequency again becomes higher than in the case wherein no grooves are provided and the movement of the curved part loses smoothness. The purpose of the provision of the grooves 33 is to increase the maximum displacement and to reduce the stiffness and, therefore, these effects are obtained when the radius R of curvature of each chamfering of a groove is in a range of from 0.1 mm to 0.3 mm.

In addition, in many cases, a complex material such as a soft cloth, rubber or the like, is used for the formation of a surrounding structure and, therefore, in practice it is difficult to form grooves 33 without chamfering. As a result, the chamfering is inevitably made.

(Third Embodiment)

Figure 15:
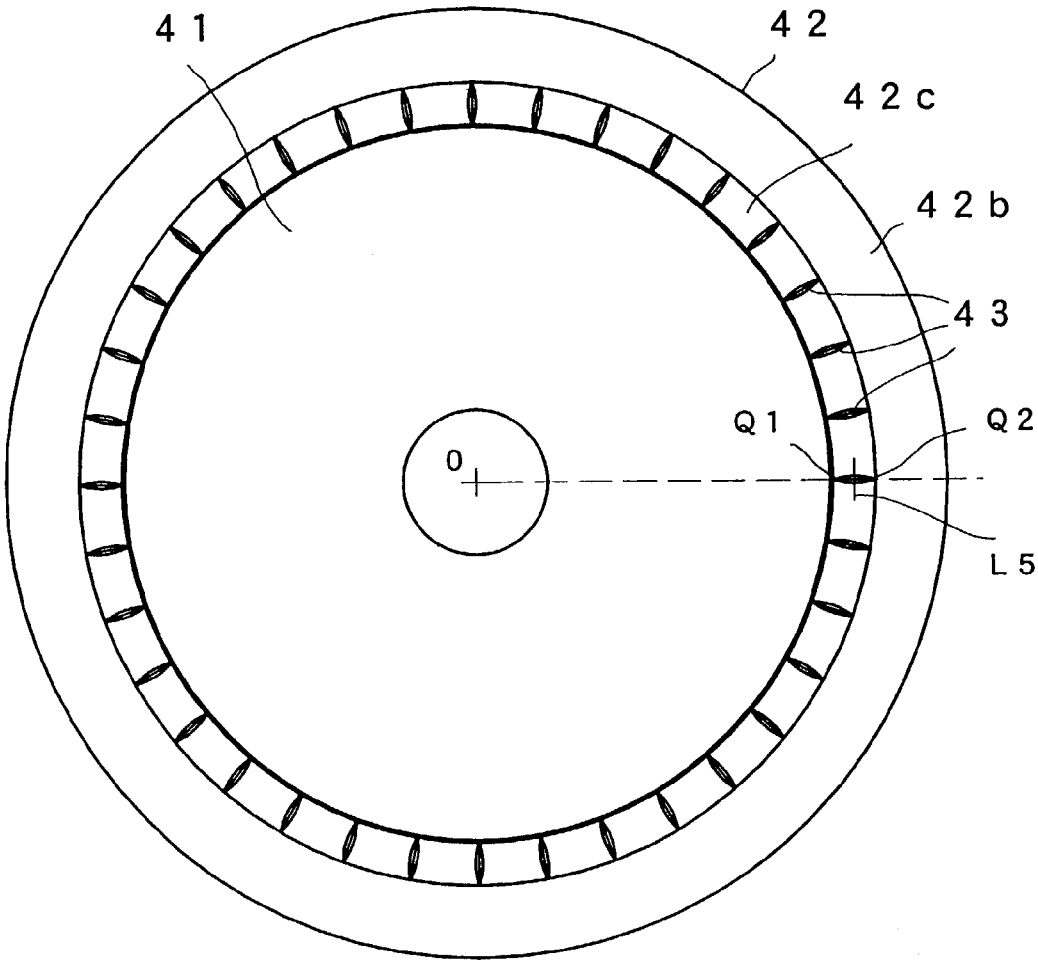
FIG. 15 is a plan view of a surrounding structure of a loudspeaker according to a third embodiment of the present invention.

Next, a surrounding structure of a loudspeaker according to a third embodiment of the present invention will be described. FIG. 15 is a plan view showing the structure of the surrounding structure of the loudspeaker and the vibrating diaphragm of a loudspeaker according to the third embodiment. The surrounding structure of the loudspeaker of the present embodiment is characterized by the elliptical cross section of the surrounding structure of the loudspeaker as in the first embodiment 1 and, in addition, is characterized in that a great number of grooves are provided in the surrounding structure of the loudspeaker and these grooves are arranged in a radial manner. The remaining parts in the configuration are the same as those in the first embodiment.

Figure 16:
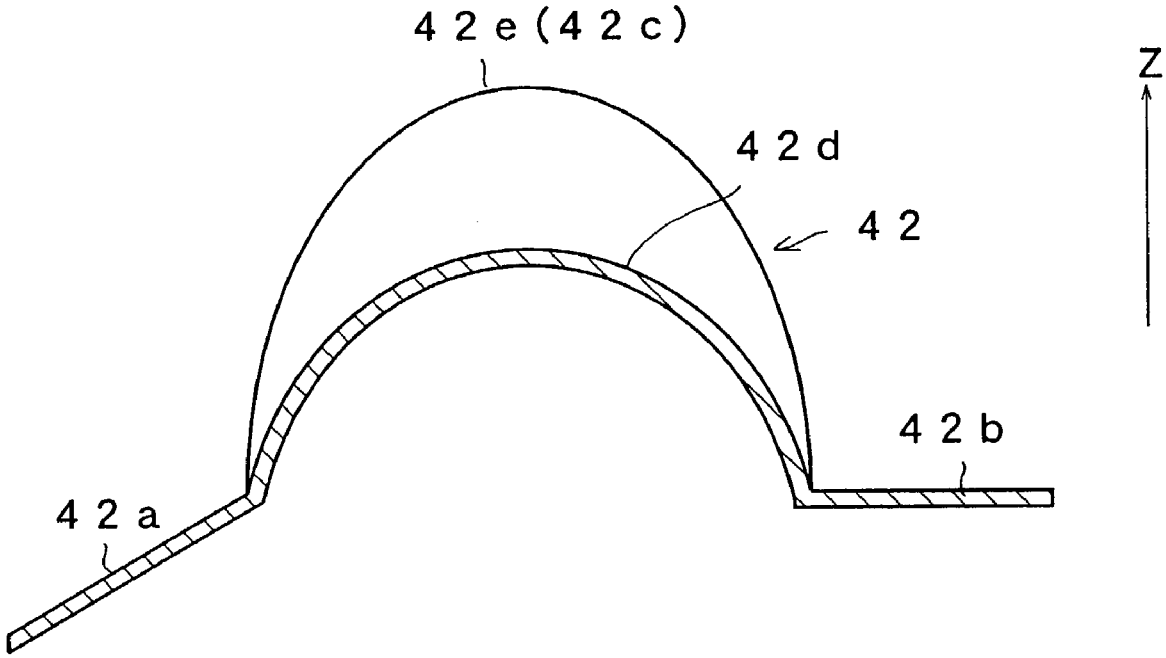
FIG. 16 is a cross sectional view showing the structure of the main portion of the surrounding structure of the loudspeaker according to the third embodiment.
Figure 17:
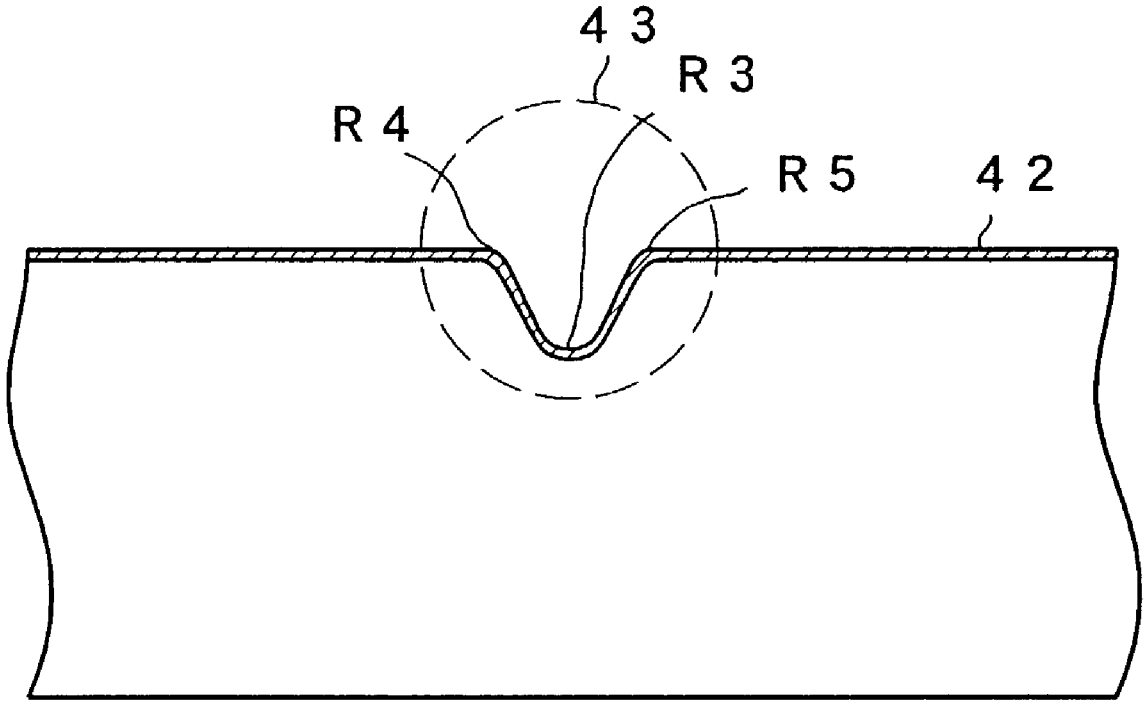
FIG. 17 is a cross sectional view showing the structure of the main portion of the surrounding structure of the loudspeaker according to the third embodiment.

FIG. 16 is a cross sectional view taken along one of the grooves and shows the structure of the main portion of the surrounding structure of the loudspeaker according to the present embodiment. FIG. 17 is a cross sectional view of the surrounding structure of the loudspeaker taken along a line in the direction perpendicular to the groove. The form of the surrounding structure of the loudspeaker, among the components shown in FIG. 4, is additionally modified in this loudspeaker.

As shown in FIG. 15, a surrounding structure 42 having grooves is secured to the outer periphery portion of a vibrating diaphragm 41. As shown in FIG. 16, the surrounding structure 42 has an attaching part 42*a*, attaching part 42*b* and curved part 42*c*, wherein the cross section along a diameter of the vibrating diaphragm 41 of the curved part 42*c* is in a hollow and approximately semi-elliptical form in the same manner as in the first and second embodiments. Thus, the major axis of the ellipse is parallel to the center axis of the vibrating diaphragm 41 and the minor axis of the ellipse is set in the direction orthogonal to the center axis of the vibrating diaphragm 41.

As shown in FIG. 15, 0 denotes the center of the vibrating diaphragm 41, Q1 (inner periphery point) denotes the point wherein a radius extending toward the outside of the vibrating diaphragm 41 from the center O crosses the inner periphery of the curved part 42*c*, and Q2 (outer periphery point) denotes the point wherein the radius crosses the outer periphery of the curved part 42*c*. Next, the grooves 43 are formed along the line Q1-Q2 according to the plastic deformation of the material of the surrounding structure of the loudspeaker. These grooves 43 are arranged in a radial manner, preferably by equal intervals, along the outer periphery portion of the vibrating diaphragm 41.

The cross section of the groove 43 taken along the line Q1-Q2 is shown in FIG. 16, wherein the bottom of the groove 43 is denoted as 42*d* and a ridge portion of the surrounding structure 42 is denoted as 42*e*. Here, the attaching part 42*a* is an attaching part of an inner periphery portion of the curved part 42*c* and the attaching part 42*b* is an attaching part of an outer periphery portion of the curved part 42*c*. Next, FIG. 17 shows the side view of the surrounding structure 42 including a cross section of the groove 43 taken along a line L5 orthogonal to the line Q1-Q2. The cross section of the groove 43 is in a U-shape or in a V-shape.

The radii of curvature of a ridge portion and of the bottom in the case where the cross section of the groove 43 is in a U-shape are shown in the cross sectional view of FIG. 17. R3 denotes the radius of curvature of the bottom of the groove 43 and R4 and R5 denote the radii of curvature of the corner portions of the groove 43. The chamfers having such radii of curvature are provided in order to prevent the material from suffering elastic fatigue and from being ruptured at these corner portions as a result of repeated application of local force to the material in the same manner as in the second embodiment. The values of the radii R3, R4 and R5 of curvature are set in a range of from 0.1 (mm) to 0.3 (mm) in the same manner as those shown in FIG. 10 taking the cross sectional width of the curved part and the thickness of the material into consideration.

A hollow and approximately elliptical form is selected for the cross section of the curved part in the surrounding structure 42, whereby the cross sectional width B of the curved part can be reduced without changing the outer diameter of the surrounding structure of the loudspeaker and the effective vibration diameter A2 can be increased in a loudspeaker having the above described structure. The efficiency of the loudspeaker thus increases since the efficiency of the loudspeaker is proportional to the effective vibration area determined by the effective vibration diameter. The above described effects are the same as in the first embodiment.

The grooves 43 are additionally provided, whereby the portions of the grooves 43 can expand in the direction of the circumference as the amount of deformation of the surrounding structure 42 increases. Therefore, the grooves 43 ease the state when suspension is spread to limitation of transformation and increases the maximum displacement of the elliptical surrounding structure.

In addition, when a surrounding structure having an elliptical cross section and having no grooves is used in order to expand the effective vibration diameter as described above, the minimum resonant frequency of the loudspeaker rises. The stiffness of the elliptical surrounding structure having such grooves 43 can be reduced significantly. Therefore, the grooves 43 become an effective means for lowering the minimum resonant frequency in the vibration system. The above described effects are the same as in the second embodiment.

Figure 18:
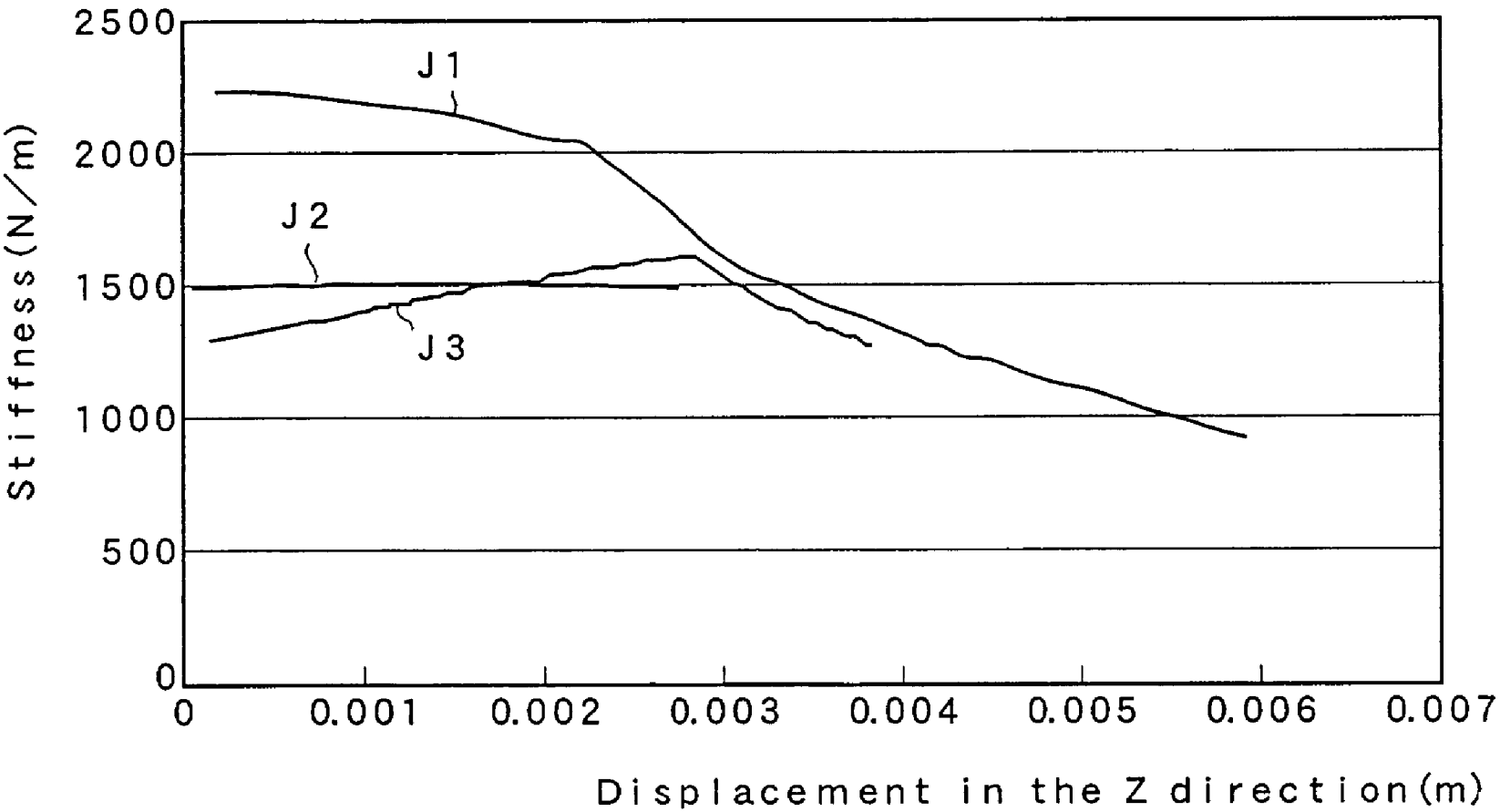
FIG. 18 is a characteristics graph showing the relationships between the displacement and the stiffness in the surrounding structure of the loudspeaker according to the respective embodiments.

FIG. 18 is a graph showing a comparison of the stiffness characteristics of respective surrounds. The lateral axis indicates the displacement [m] in the Z direction and the longitudinal axis indicates the stiffness [N/m]. This graph shows the stiffness characteristics of the elliptical surrounding structure J1 with no grooves, the stiffness characteristics of the elliptical surrounding structure J2 with grooves (angle $\alpha$=10°) of the second embodiment, and the stiffness characteristics of the elliptical surrounding structure J3 with grooves in the third embodiment, respectively. These characteristics show the difference between the stiffness characteristics of the surrounding structure of the loudspeaker of the present embodiment having the same elliptical cross section wherein grooves are provided in a radial manner and the stiffness characteristics of other surrounds having an elliptical cross section.

According to FIG. 18, the maximum displacement further increases in the surrounding structure 42 wherein the grooves 43 are provided in a radial form as in the elliptical surrounding structure J3 with grooves. This embodiment is effective wherein the expansion of the maximum displacement of the elliptical surrounding structure is important.

Here, though in FIG. 15 the number of the grooves 43 provided in a radial manner is 36, the number is arbitrary. Furthermore, though in FIG. 16 the cross section of the bottom portions 42*d* of the grooves 43 is in approximately semi-elliptical form, these portions may be in a semi-circular form. The designer or manufacturer of the loudspeaker can freely select the form of the grooves and the manner of arrangement of the grooves, taking the feasibility of the formation of the material, the linearity of the amplitude, the maximum displacement and the minimum resonant frequency of the loudspeaker into consideration.

As described above, the stiffness of the elliptical surrounding structure with grooves at the time of high amplitude can be reduced in comparison with the elliptical surrounding structure with no grooves so that the range of elastic deformation of a diaphragm in the axis direction can be further expanded. Thereby, the surrounding structure of the loudspeaker, of which the curved part has a narrow cross sectional width, improves the linearity of the amplitude, and the loudspeaker increases efficiency, reduces minimum resonant frequency, increases the ability of low frequency reproduction, and increases maximum sound pressure.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

The text of Japanese priority application no. 2002-142641 filed on May 17, 2002 is hereby incorporated by reference.

What is claimed is:

1. A surround of the loudspeaker, which is used for a loudspeaker having a vibrating diaphragm and a frame, having an annular structure where an outer periphery of the surround of the loudspeaker is secured to the frame, an inner periphery of the surround of the loudspeaker is secured to the outer periphery of the vibrating diaphragm and a curved part encircles the outer periphery of the vibrating diaphragm, wherein a cross section of said curved part along the diameter direction of the vibrating diaphragm is in the form of a hollow and approximately semi-ellipse, the ratio of a width, from a vertex of said semi-ellipse to an inner end of said outer periphery of said surround, along the minor axis of said semi-ellipse to a height, from another vertex of said semi-ellipse to a surface of said outer periphery of said surround, along the major axis of said semi-ellipse is at least 1.14, and said major axis of said semi-ellipse is parallel to the center axis of the vibrating diaphragm and the minor axis of said semi-ellipse is set in the direction orthogonal to the center axis of the vibrating diaphragm, a plurality of grooves are provided by equal intervals at positions along the annular form of said curved part, a plurality of pairs of an inner periphery point and an outer periphery point are posited so that each of the pairs corresponds to both ends of said grooves, where said inner periphery point is the point on the inner periphery of said curved part, said outer periphery point is the point on the outer periphery of said curved part, and said grooves are formed due to a plastic deformation of the material of said surround such that a cross sectional form of said grooves is one of a V-shape and of a U-shape.

2. The surround of the loudspeaker according to claim 1, wherein a center angle formed between a first line, which connects the center of the vibrating diaphragm and said inner periphery point, and a second line, which connects said center and said outer periphery point is in a range of at least 0° and at most 40°.

3. The surround of the loudspeaker according to claim 1, wherein the radius of curvature of an angle in the cross section of said grooves is in a range of from 0.1 mm to 0.3 mm.

4. The surround of the loudspeaker according to claim 1, wherein said curved part has a uniform thickness.

* * * * *